United States Patent [19]

Tada

[11] 4,061,250

[45] Dec. 6, 1977

[54] DEPRESS BUTTON TYPE SPRAYER

[76] Inventor: Tetsuya Tada, 2-6, 3-chome, Nishinakanobu, Shinagawa, Tokyo, Japan

[21] Appl. No.: 689,750

[22] Filed: May 25, 1976

[30] Foreign Application Priority Data

May 31, 1975 Japan ..... 50-65533
Nov. 26, 1975 Japan ..... 50-160023[U]

[51] Int. Cl.[2] ..... B05B 9/043

[52] U.S. Cl. ..... 222/321; 239/333; 251/244; 251/321

[58] Field of Search ..... 239/331, 333, 573, 579; 222/335, 383, 385, 402.13, 341; 251/231, 236–246, 319–324

[56] References Cited

U.S. PATENT DOCUMENTS

| | | | |
|---|---|---|---|
| 1,937,344 | 11/1933 | Hollingsworth | 222/385 |
| 3,185,172 | 5/1965 | Hajek | 251/239 X |
| 3,187,960 | 6/1965 | Gorman | 222/383 X |
| 3,897,006 | 7/1975 | Tada | 239/333 |

FOREIGN PATENT DOCUMENTS

| | | | |
|---|---|---|---|
| 645,287 | 10/1928 | France | 239/333 |
| 1,972,000 | 2/1967 | Germany | 239/579 |
| 648,460 | 1/1951 | United Kingdom | 222/385 |
| 1,073,440 | 6/1967 | United Kingdom | 222/385 |
| 336,528 | 10/1930 | United Kingdom | 222/385 |

*Primary Examiner*—Evon C. Blunk
*Assistant Examiner*—Andres Kashnikow
*Attorney, Agent, or Firm*—Flynn & Frishauf

[57] ABSTRACT

A depress button type sprayer comprises a piston slidably inserted into a cylinder and provided with a liquid jetting nozzle, a lever for moving the piston into the cylinder against the force of a spring and a depress button for operating the lever.

9 Claims, 9 Drawing Figures

DEPRESS BUTTON TYPE SPRAYER

This invention relates to a depress button type sprayer manually operable to jet liquid such as an insecticide, a coating liquid, etc.

In general, a depress button type sprayer can be made compact as compared with a trigger-like handle type sprayer and be simply constructed with less material. A known depress button type sprayer has a sprayer body including a cylinder chamber, a piston slidably inserted into the chamber and a depress button mounted on the upper end of the piston. For this reason, a pressure created within the cylinder chamber is made equal to a depressing force exerted by the finger of the user on the depress button, resulting in a relatively low pressure. This causes the atomized particles of a liquid to become coarse with the attendant non-uniform distribution of the liquid particles. Such a depress button type sprayer can not be used in a field where the uniform distribution of fine particles is required, and it finds a limited application.

It is accordingly the object of this invention to provide a depress button type sprayer which is simple in construction and capable of developing an appreciably great pressure within a cylinder so as to jet fine liquid particles with uniform distribution.

DETAILED DESCRIPTION

Figure 1:
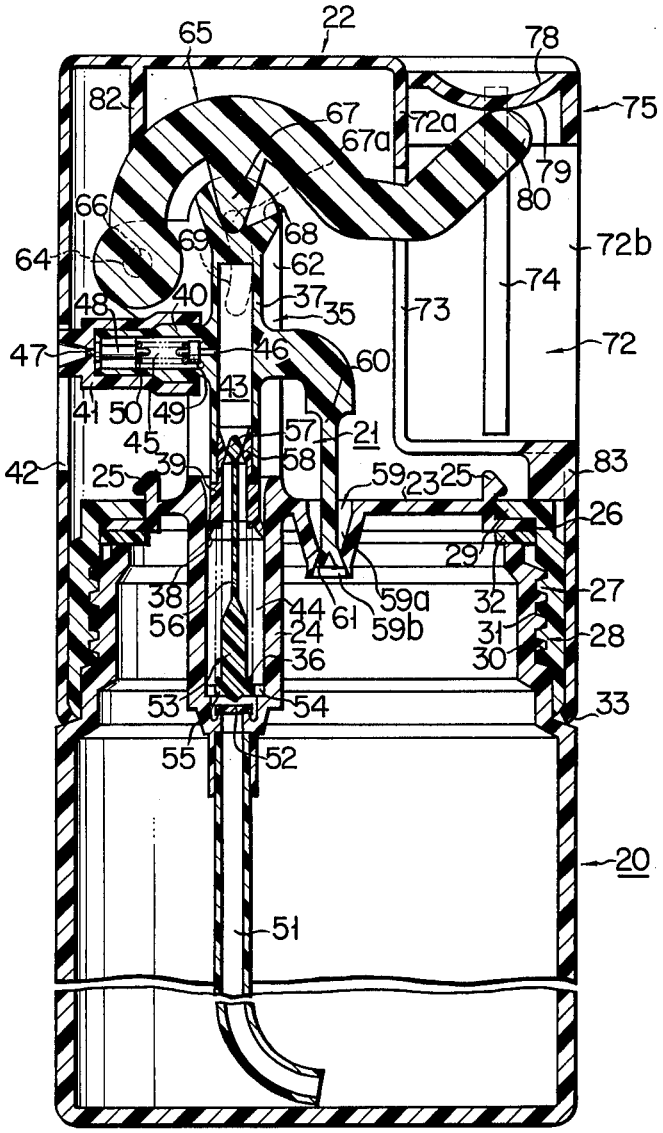
FIG. 1 is a longitudinal cross-sectional view showing a sprayer according to one embodiment of this invention with a piston in the uppermost position.

Substantially all of the depress-button type sprayer in FIG. 1 is made of a suitable plastic and has a sprayer body 21 mounted on the upper portion of a cylindrical liquid container 20 and a substantially cylindrical cap housing 22 covering the sprayer body 21 from above. The body 21 has a cylindrical 24 integrally molded in a substantially vertical direction to a substantially circular base plate 23. The base plate 23 has a pair of hooks 25 at the outer periphery and an annular outer flange 26. A fastening ring 28 is provided with an internally threaded portion 27 at the inner surface and an annular inner flange 29 at the upper end. The inner flange 29 of the fastening ring 28 is disposed between the hook 25 and the outer flange 26 of the base plate 23. The liquid container 20 includes at the upper portion a mouth portion 31 having an externally threaded portion 30 at the outer periphery. A seal ring 32 is positioned between the upper end of the mouth portion 31 and the inner flange 29 of the fastening ring 28. During assembly, the sprayer body 21 is so set as to be located at a predetermined position to the liquid container 20 and then the fastening ring 28 is screw threaded over the mouth portion 31 of the liquid container 20. The inner flange 29 of the fastening ring 28 causes the outer flange 26 of the base plate 23 and the sealing ring 32 to be pressed in a liquid-tight fashion toward the upper end of the mouth portion 31 of the liquid container. The cap housing 22 is so fitted from above over the fastening ring 28 that its lower annular projection 33 is engaged with the lower end of the fastening ring 28.

The sprayer body 21 further includes a piston 35 slidably inserted in a liquid-tight fashion through an upper opening of the cylinder 24 and the piston 35 is normally upwardly urged by a compression spring 36. The piston 35 includes a piston body 37, a slide member 39 pressed into the piston body 37 and having a flared portion 38 engaged in a liquid-tight fashion with the inner wall of the cylinder 24, and a nozzle cap 41 engaged in a liquid-tight fashion with a projection 40 which extends horizontally from the piston body 37. The forward end of the nozzle cap 41 is inserted in an elongated slot 42 in the front wall of the cap housing so that it can be freely vertically moved in the elongated slot of the cap housing. A cavity 43 is formed within the piston 35 and the cavity 43 of the piston 35 communicates at the lower end with a chamber 44 in the cylinder 24. A cavity 25 is formed within the projection 40 and communicates with the cavity 43 of the piston 35 through a bore 46. The cavity 45 of the projection 40 is opened to the outer atmosphere through a dispensing hole 47 provided in the forward end of the nozzle cap 41. A known swirl member 48 is disposed within the cavity 45 of the projection 40 and adjacent to the dispensing hole 47 of the projection 40 and it is adapted to swirl a liquid off toward the dispensing hole 47. A first one-way valve 49 is disposed within the cavity 45 and is normally urged by a compression spring 50 to cause the bore 46 to be closed. On the lower end portion of the cylinder 24 is mounted a pipe 51 which conducts a liquid from the container 20 to the chamber 44. At the bottom of the chamber 44 is disposed a second one-way valve 52 which permits the liquid to be supplied from the container through the pipe 51 to the chamber 44. Within the chamber 44 is placed a valve 53 for preventing a liquid leakage from the chamber 44 to the nozzle during the non-operative time of the sprayer. The valve 53 comprises a fixed disc 55 fitted to the inner wall of the chamber 44 and having grooves 54 at the outer periphery, a rod 56 extending from the disc and having a slender upper section, and a valve element 57 integrally formed at the upper end of the rod 56. The slide member 39 of the piston 35 has a narrow passage portion 58 and the rod 56 of the valve 53 passes through the narrow passage protion 58 to permit the valve element 57 to be projected into the cavity 43. When the piston 35 in FIG. 1 is in the uppermost position, the valve element 57 is engaged with the inner wall of the narrow passage portion 58 to shut off the communication between the chamber 44 and the cavity 43. When, however, the piston 35 is at a position lower than that shown in FIG. 1, the cavity 44 always communicates with the cavity 43 through a clearance between the rod 56 and the narrow passage portion 58.

A hole 59 is provided in the base plate 23 to prevent a negative pressure from being generated within the container 20 and the hole 59 comprises a larger upper section 59*a* of an inverted truncated cone and a small lower section 59*b* of a normal truncated cone to permit the interior of the container to communicate with the outer atmosphere. A rod 60 is integrally formed on the piston 35 and extends downwardly with respect to the piston 35 to be inserted into the hole 59. The lower portion of the rod 60 has a diameter smaller than the smallest diameter portion of the hole 59 and a conical blocking portion 61 is integrally formed at the lower end of the rod 60. When the piston 35 is in the uppermost position as shown in FIG. 1, the conical blocking portion 61 abuts in an airtight fashion against the inner wall of the lower section 59*b* of the hole 59 to permit the hole 59 to be closed. When the piston 35 is in a position lower than that shown in FIG. 1, the conical blocking portion 61 is moved away from the inner surface of the lower section 59*b* of the hole 59 to permit the hole 59 to be opened.

Figure 2:
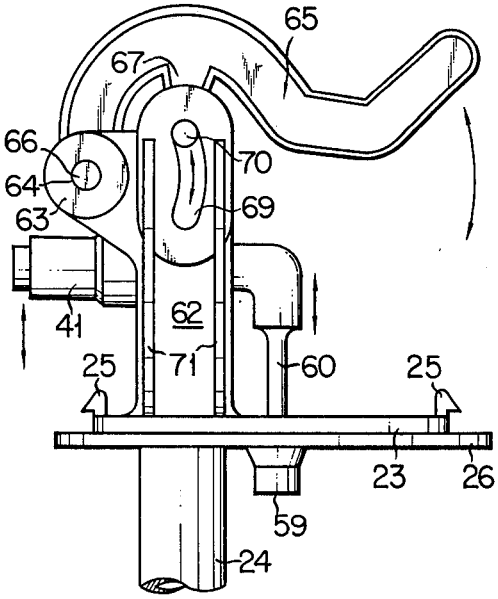
FIG. 2 is a front view showing a body of the sprayer as shown in FIG. 1.
Figure 3:
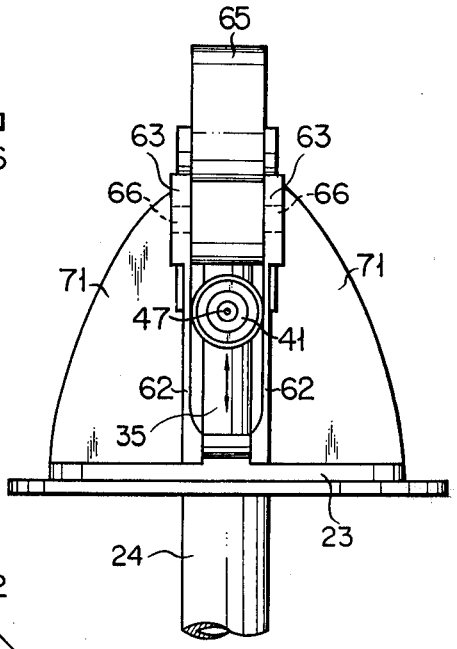
FIG. 3 is a left side view partly showing the sprayer in FIG. 2.

As shown more in detail in FIGS. 2 and 3, a pair of support members 62, parallel to each other, integrally and upwardly extend from the base plate 23 to permit the piston 35 to be interposed between the support members 62, and a pair of pin support portions 63, parallel to each other, integrally forwardly extend from the upper portions of the support members 62. The pin support portion constitutes a thick circular portion having a pin hole 64. The sprayer is further provided with a lever 65 for operating the piston 35. Pivot pins 66 integrally horizontally extend one from each side of the forward end of the lever 65 and are each rotatably supported in the pin hole 64 of the pin support portion 63. The pin hole 64 is positioned forwardly away from the center axis of the piston 35. The lever 65 clears the upper end of the piston 35 in a manner to describe a substantially semicircle and is integrally provided with a downwardly extending piston depressing projection 67. The lower end of the projection 67 describes the arc of a small circle 67*a*. A sectional cutout 68 is provided at the upper end portion of the piston and bears the lower end of the piston depressing projection 67. An elliptical thick reinforcing section is provided at the upper end portion of the support member 62. At the elliptical thick section of the support member 62 is provided a guide slot 69 which describes an arc with the pin hole 64 as a center. A pair of guide pins 70 (only one is shown in FIG. 2) laterally extend from each side of the lower end of the piston depressing projection 67 and they are slidably engaged with the slots 69 in a manner to be guided by the slots 69. The support members 62 are reinforced by a pair of ribs 71 so that they are not displaced outwardly.

Figure 4:
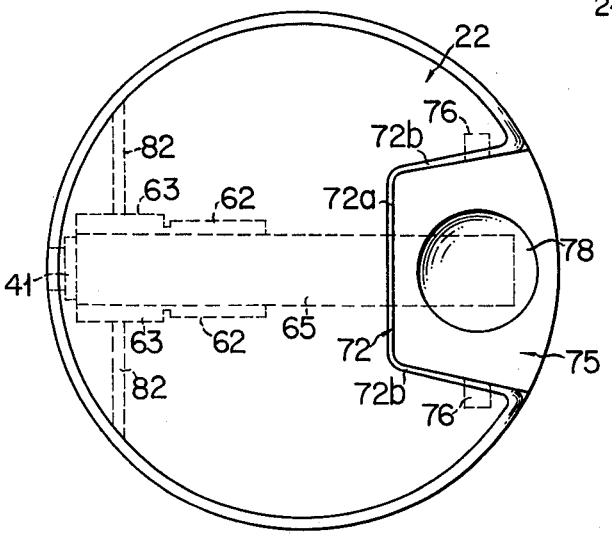
FIG. 4 is a plan view showing the sprayer in FIG. 1.
Figure 5:
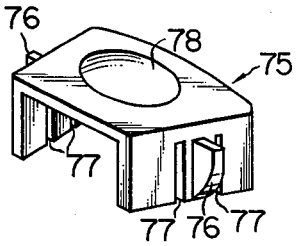
FIG. 5 is a perspective view showing a depress button shown in FIG. 1.

At the rear of the cap housing 22 is a recess 72, substantially trapezoidal in cross section, defined by a front wall 72*a* and a pair of side walls 72*b* and extending in the longitudinal direction of the sprayer (see in FIGS. 1 and 4). The front wall 72*a* of the recess 72 has a lengthy slot 73 and the rear portion of the lever 65 is inserted through the slot 73 into the recess 72. Each side wall 72*b* of the recess 72 provides a button guide surface and has a downwardly extending linear slot 74. A depress button 75 having substantially the same cross section as that of the recess 72 is slidably inserted in the vertical direction of the recess 72 and is so designed that it can be moved in a direction substantially parallel to that in which the piston 35 is moved. A guide projection 76 (FIG. 5) is integrally formed at each side of the depress button and so engaged with the slot 74 that it can be moved therealong. The guide projection 76 has a planar upper surface which serves as a stop for abutting against the upper wall of the slot 74. The guide projection is downwardly inwardly curved in a manner to describe an arc and a pair of slits 77 are provided, as shown in FIG. 5, at each side of the guide projection 76. When the depress button 75 is inserted from above into the recess 72, the guide projection 76 is elastically deformed and snap-fitted into the slot 74 of the recess 72. In the upper surface of the depress button 75 is provided a concave recess 78 with which the finger of the user is engaged. The rear surface of the recess 72 is correspondingly curved outwardly to provide a convex surface 79 as shown in FIG. 1. A semi-circular portion 80 is defined at the rear end of the lever 65 and it is engaged with the convex surface 79 of the depress button. The lever 65 is normally urged, through the piston 65 and under the action of the spring 36, in the position shown in FIG. 1 and at this time the depress button 75 is held, by the rear end 80 of the lever, in the uppermost position.

Figure 6:
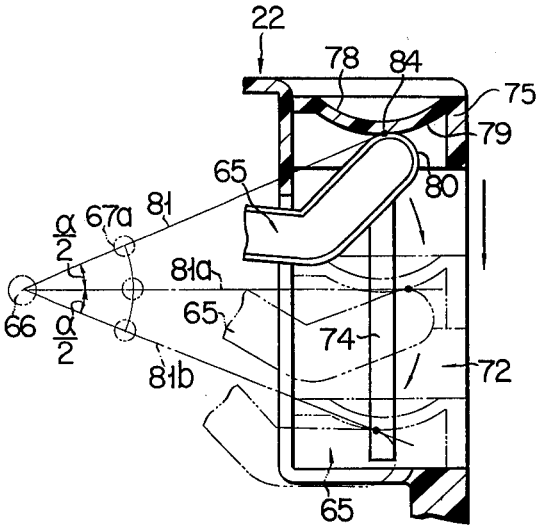
FIG. 6 is a diagram showing an operative relation between a lever and the depress button in FIG. 1.

In this embodiment, the sprayer is so designed that the center point of the pin 66 on the lever 65, the center point of the small circle 67*a* and a contact point 84 between the depress button and the lever 75 are positioned substantially on a straight line 81 as shown in FIG. 6 and that the center point of the pin 66 is located substantially on a line passed through the midpoint of a whole stroke over which the contact point 84 between the lever 65 and the depress button is moved.

As shown in FIGS. 1 and 4 a pair of reinforcing ribs 82 integrally extend from the front inner wall of the cap housing 22 toward each other. The ribs 82 support the pin support portions 63 of the support members 62 from the corresponding sides to prevent the pin support portions 63 from being displaced outwardly. A plurality of projections 83 (only one is shown in FIG. 1) are integrally and equidistantly provided on the lower portion of the inner wall of the cap housing 22 and they abut against the top surface of the inner flange 29 of the fastening ring 28 to restrict the degree to which the cap housing 22 is fitted with respect to the container 20.

The operation of the sprayer will now be explained below.

Figure 7:
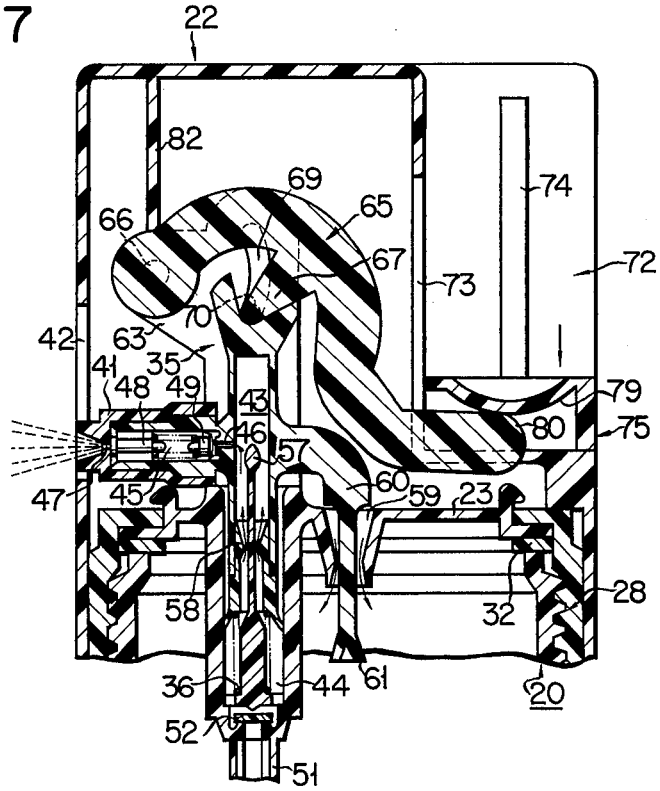
FIG. 7 is a partial, longitudinal cross-sectional view in which the piston is shown in the lowermost position.

When the depress button 75 is downwardly depressed, by the finger of the user, from the position shown in FIG. 1, the lever 65 is swung downward, through the depress button 75, with the pin 66 as a center to cause the piston 35 to be forcibly downwardly depressed through the projection 67. At this time the nozzle cap 41 is lowered along the slot 42 and a force exerted by the depressing projection 67 on the piston 35 is appreciably greater than a force acting on the rear end 80 of the lever 65. For this reason, a liquid within the chamber 44 and the cavity 43 enters through the hole 46 and one-way valve 49 into the cavity 45 and then through the swirl member 48 to permit the liquid to be atomized or jetted in the form of fine liquid particles from the dispensing hole 47 as shown in FIG. 7. The atomized pattern of the liquid has a uniform distribution of fine particles due to the relatively high pressure as mentioned above. The downward depression of the piston 35 causes the valve element 57 to open the passage portion 58 to permit the liquid to be freely passed from the cylinder chamber 44 to the cavity 43. At the same time, the conical blocking portion 61 is moved downward to cause the hole 59 to be opened to permit air to flow from the outer atmosphere into the container 20. When the force acting on the depress button 75 ceases to exist, the piston 35 is pushed upwardly by the compression spring 36 and at the same time the depress button 75 is raised through the lever 65. At this time, a negative pressure created within the cylinder chamber 44 and the cavity 43 opens the one-way valve 52 to cause the liquid to be sucked from the container 20 through the pipe 51 into the cylinder chamber 44. When the depressed button 75 is again depressed, the above-mentioned operation is repeated In this embodiment the rear end 80 of the lever 65 is shaped substantially in the semi-circular form and point-contacted with the convex surface 79 of the depress button. When therefore, the depress button 75 is moved in a straight line fashion to permit the lever 80 to be moved in a manner to describe an arc as shown in FIG. 6, the rear end 80 of the lever 65 can be smoothly moved along the convex surface 79 of the depress button. As shown in FIG. 6 a straight line 81*a* passing through the center of the pin 66 and intersecting vertical to the straight line movement path of the depress button 75 bisects an angle $\alpha$ made between a straight line 81 defined in the uppermost position of the depress button 75 and a straight line 81*b* defined in the lowest position of the depress button 75. For this reason, the contact point 84 between the depress button 75 and the lever 65 is slidably moved only a slight distance along the convex surface 79 of the depress button 75, making minimal the friction occurring at the contact point between the depress button 75 and the lever 65. Moreover, an arcuate movement path described by the lower end 67*a* of the depressing projection 67 of the lever 65 substantially lies on the center axis of the piston 35 and in consequence the piston 35 is substantially vertically moved, or hardly laterally displaced during the operation of the lever 65.

During the operation of the lever 65 a strong force acts on the pin support portion 63 through the pin 66, but it is borne by the thick pin support portion 63. The pin support portions 63 have a tendency to be separated away from each other due to the force, but this tendency is prevented by the ribs 82. The lever 65 can be accurately moved, since it is guided by the guide pins 70 engaged with the guide slots.

During the non-operative time of the sprayer, i.e., when the piston 35 is in the uppermost position, the valve element 75 closes the passage portion 58 and the conical blocking portion 61 closes the hole 59. As a result, the leakage of the liquid as well as the evaporation of the flow is almost prevented.

Figure 8:
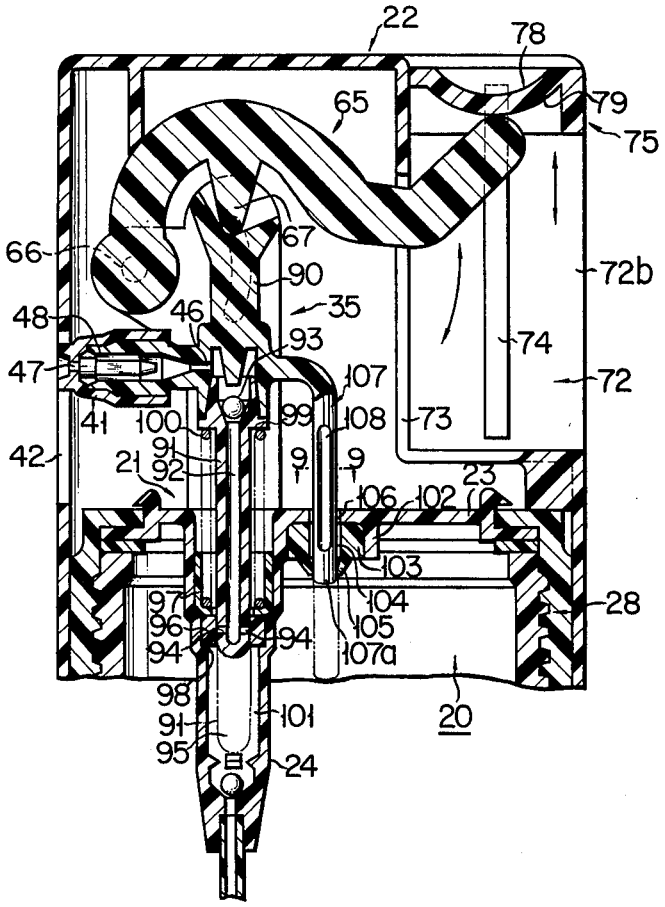
FIG. 8 is a partial, longitudinal cross-sectional view showing a sprayer according to another embodiment of this invention.
Figure 9:
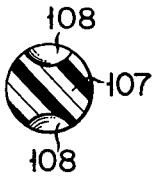
FIG. 9 is a cross-sectional view as taken along line 9—9 in FIG. 8.

FIG. 8 shows a sprayer according to another embodiment of this invention. Like reference numerals are employed in this embodiment to designate parts and elements corresponding to these shown in the first embodiment of this invention and further explanation will be omitted for the sake of brevity.

In this embodiment the piston 35 has a body 90 equipped with a nozzle cap 41 and a slide member 91 inserted in a liquid-tight fashion in the lower portion of the body 90. The slide member 91 downwardly extends in the form of a cylinder in the longitudinal direction of the sprayer and has a cavity 92. A one way valve 93 is disposed at the upper end portion of the cavity 92. The cavity 92 is closed at the lower end and, instead, the cavity 92 is radially opened, through a plurality of holes 94, in the neighborhood of the lower end of the slide member 91. Like the first embodiment, a lever depressing projection 67 of a lever 65 is engaged with the upper end of the piston 35 and a depress button 75 is engaged with the rear end of the lever 65.

A cylinder 24 is integrally provided with a base plate 23 and has a cylinder chamber 95. At the upper end portion of the cylinder 24 is fitted a seal ring 96 made of a suitable elastic material such as rubber, plastics, etc. A cup-like holding member 97 is fitted on the upper end of the seal ring 96 to permit the seal ring 96 to be fixedly held at a stepped portion 98 of the cylinder 24. A compression spring 100 is disposed between the cup-like holding member 97 and a stepped portion 99 of the piston 35 to cause the piston 35 to be normally urged upwardly. The slide member 95 of the piston is passed, in a liquid-tight fashion, through the center hole of the seal ring 96 so as to be slidably moved. The slide member 91 has an outer diameter smaller than the inner diameter of the chamber 95 so that, during the downward stroke of the slide member 91 as indicated by a dash dot line in FIG. 8, a clearance 101 is defined between the inner wall of the chamber 95 and the outer wall of the slide member 91.

In the neighborhood of the cylinder 24 an annular projection 102 is integrally provided on the undersurface of the base plate 23. To the annular projection 102 is fitted a seal member 103 made of a suitable material such as rubber etc. The seal member 103 has a through bore 104 and is provided with a flexible lip 105 of an inverted truncated cone configuration. The base plate has a hole 106 in alignment with the hole 104 of the seal member 103, and the holes 104 and 106 are cooperated to define a passage for preventing a negative pressure from being created within the container 20. The body 90 of the piston 35 has an integrally formed rod 107 circular in cross section and the rod 107 extends, through the holes 104 and 106, into the container 20. The lip 105 of the seal member 103 is fitted in an airtight fashion over the rod 107 normally in the neighborhood of the lower end of the rod 107. Grooves 108 are formed in the rod 107 in the longitudinal direction of the rod 107. The lower end of the groove 108 terminates a predetermined distance from the lower end of the rod 107 to leave a blocking portion 107*a* circular in cross section. The rod 107 is so designed that when the piston 35 is in the uppermost position as indicated by a solid line in FIG. 8 the lip 105 of the sealing member 103 is fitted in an airtight fashion over the outer surface of the block portion 107*a* of the rod 107.

The operation of this embodiment will be explained below.

When the depress button 75 is depressed as in the first embodiment to cause the piston 35 to be moved downward through the lever 65, the slide member 91 is advanced into the cylinder chamber 95 to permit the holes 94 to be opened in the cylinder chamber 95. As a result, a liquid in the chamber 95 flows through the clearance 101 and holes 94 into the cavity 92 of the slide member 91 and then through the one-way valve 93 into the cavity 45 and it is atomized from a dispensing hole 74 through a swirl member 48. When the piston 35 is slightly lowered from a position as shown in FIG. 8, the blocking portion 107*a* of the rod 107 is moved away from the lip 105 of the sealing member 103 to cause the lip 105 to be engaged with the grooved rod portion to permit air to flow from the outside through the grooves 108 of the rod 107 into the container 20.

During the non-operative time of the sprayer, i.e., the sprayer is in the uppermost position as indicated in FIG. 8, the holes 94 of the slide member 91 are blocked by the seal ring 96 and at the same time a negative pressure preventing hole, consisting of the holes 104 and 106, is also blocked by engagement of the lip 105 with the blocking portion 107*a* of the rod 107. During the non-operative time of the sprayer, therefore, the leakage or evaporation of the liquid from the container 20 is substantially prevented.

In the above-mentioned two embodiments, the lever 65 is engaged with the upper end of the piston 35 through the depressing projection 67. Instead, a pair of pins can be provided laterally on the outer wall of the piston so that the lever can be engaged with the pins. The spray nozzle may be provided on the cylinder, not on the piston. In this case it is advisable that a portion of the cylinder 24 extends upwardly from the base plate 23 and the nozzle is provided on the upper portion of the cylinder.

What is claimed is:

1. A depress button sprayer comprising:

a spray body provided with a cylinder having an opening at one end;

a piston slidably mounted in a liquid-tight fashion in the cylinder;

spring means for urging the piston outwardly of the cylinder;

a nozzle in communication with the cylinder and having a dispensing hole for jetting a liquid from within the cylinder;

a pivotable lever coupled to the piston for sliding the piston into the cylinder against the force of the spring means, the lever having a rounded free end;

a pivot for pivotally supporting the lever in a position spaced from the axis of the piston;

a cap housing for covering the spray body and the lever, the cap housing having a longitudinally extending recess at the rear upper portion thereof; and a depress button slidably received in the recess and drivingly point-contacted with the rounded free end of the lever.

2. A depress button sprayer according to claim 1, wherein the rear surface of the depress button has a convexly curved portion for engaging the rounded free end of the lever.

3. A depress button sprayer according to claim 2, wherein the upper surface of the depress button has a concave portion to receive an operator's finger.

4. A depress button sprayer according to claim 2, wherein the recess of the cap housing is defined by a pair of side walls and a front wall of the cap housing, each side wall having a longitudinally extending slot therein, and wherein a guide projection is formed on each side of the depress button, the guide projections being slidably engaged in respective slots in the side walls of the cap housing.

5. A depress button sprayer according to claim 4, wherein each guide projection has a planar upper surface which acts as a stop for abutting against the upper wall of the slot and a downwardly and inwardly curved side face which so acts to permit the guide projection to be snap-fitted into the slot.

6. A depress button sprayer according to claim 5, wherein each side of the depress button is provided with a pair of slits between which each guide projection is formed.

7. A depress button sprayer according to claim 2, wherein the sprayer body has a pair of support members for supporting the pivot, and the cap housing has ribs for preventing the support members from being displaced away from each other.

8. A depress button sprayer according to claim 2, wherein the lever has a piston-depressing portion which is engaged with the piston between the pivot and the depress button, the piston-depressing portion having a pair of projections, and each of the support members has a curved slot for guiding the projection.

9. A depress button sprayer comprising:

a spray body provided with a cylinder having an opening at one end;

a piston slidably mounted in a liquid-tight fashion in the cylinder;

spring means for urging the piston outwardly of the cylinder;

a nozzle in communication with the cylinder and having a dispensing hole for jetting a liquid from within the cylinder;

a pivotable lever coupled to the piston for sliding the piston into the cylinder against the force of the spring means, the lever having a rounded free end;

a pivot for pivotally supporting the lever in a position spaced from the axis of the piston;

a cap housing for covering the spray body and the lever, the cap housing having a longitudinally extending recess at the rear upper portion thereof; and a depress button slidably received in the recess and drivingly line-contacted with the free end of the lever.

* * * * *